US008750728B2

(12) United States Patent
Hayakawa et al.

(10) Patent No.: US 8,750,728 B2
(45) Date of Patent: Jun. 10, 2014

(54) IMAGE FORMING APPARATUS THAT COMPARES STORED ID INFORMATION TO DETERMINE WHETHER TO PERMIT USE OF A REPLACEMENT PART

(75) Inventors: Yoichi Hayakawa, Tokyo (JP); Yukio Ito, Tokyo (JP)

(73) Assignee: Oki Data Corporation, Tokyo (JP)

( * ) Notice: Subject to any disclaimer, the term of this patent is extended or adjusted under 35 U.S.C. 154(b) by 361 days.

(21) Appl. No.: 13/219,769

(22) Filed: Aug. 29, 2011

(65) Prior Publication Data

US 2012/0051758 A1 Mar. 1, 2012

(30) Foreign Application Priority Data

Aug. 30, 2010 (JP) ..... 2010-192542

(51) Int. Cl.
*G03G 15/00* (2006.01)
*G03G 15/08* (2006.01)

(52) U.S. Cl.
USPC ..... 399/12; 399/27

(58) Field of Classification Search
USPC ..... 399/12, 24, 27
See application file for complete search history.

(56) References Cited

U.S. PATENT DOCUMENTS 8,027,048 B2 * 9/2011 Testardi et al. ..... 399/12
8,145,075 B2 * 3/2012 Abe ..... 399/12
8,405,850 B2 * 3/2013 Kawai ..... 399/12

FOREIGN PATENT DOCUMENTS

JP 2002-169428 A 6/2002
JP 2002-333800 A 11/2002
JP 2008-003259 A 1/2008

* cited by examiner

*Primary Examiner* — William J Royer
(74) *Attorney, Agent, or Firm* — Marvin A. Motsenbocker; Mots Law, PLLC

(57) ABSTRACT

An image forming apparatus includes: an apparatus body settable to any of at least first and second modes; a replacement part detachably attachable to the apparatus body; a first storage provided in the apparatus body and configured to store ID information for at least a selected one of the first and second modes; a second storage provided in the replacement part and configured to store ID information of the replacement part; and a determination section configured to compare the ID information of the apparatus body stored in the first storage with the ID information of the replacement part stored in the second storage to determine whether to permit use of the replacement part, wherein the second storage of the replacement part shipped with the image forming apparatus stores at least first ID information for the first mode and second ID information for the second mode.

12 Claims, 17 Drawing Sheets

IMAGE FORMING APPARATUS THAT COMPARES STORED ID INFORMATION TO DETERMINE WHETHER TO PERMIT USE OF A REPLACEMENT PART

CROSS REFERENCE TO RELATED APPLICATIONS

This application claims priority based on 35 USC 119 from prior Japanese Patent Application No. 2010-192542 filed on Aug. 30, 2010, entitled "IMAGE FORMING APPARATUS AND METHOD OF MANAGING USE OF REPLACEMENT PART", the entire contents of which are incorporated herein by reference.

BACKGROUND OF THE INVENTION

1. Field of the Invention

The present invention relates to an image forming apparatus including a detachably-attachable replacement part such as a toner cartridge or a development unit and to a method of managing use of the replacement part.

2. Description of Related Art

Image forming apparatus use replacement parts detachably-attachable to apparatus bodies thereof, such as toner cartridges. In one of known techniques to determine whether a replacement part is compatible with an apparatus body, the replacement part stores specific information, and the apparatus body reads the specific information to determine the compatibility of the replacement part in the process of attaching the replacement part to the apparatus body (Japanese Patent Laid-open Publication No. 2008-3259 (see FIG. 6), for example).

SUMMARY OF THE INVENTION

In recent years, contracts in which charge is based on the number of prints such as managed printing services (MPS) have been spreading instead of direct charge on toner cartridges. Herein, the image forming apparatus under an MPS contract is called an MPS model and is described distinctively from an image forming apparatus in which toner cartridges are directly charged (a normal model). Generally, an image forming apparatus is set to the normal or MPS model in the factory before shipment.

In this regard, replacement parts (toner cartridges, development units, and the like) are managed in different ways between the normal and MPS models. Accordingly, the replacement parts of the normal and MPS models need to be exclusive of each other. To be specific, an image forming apparatus of the normal model needs to use replacement parts for the normal model, and an image forming apparatus of the MPS model needs to use replacement parts for the MPS model. For this reason, it is necessary to prepare two types of replacement parts shipped with the image forming apparatus for both the cases where the shipped image forming apparatus is used as the normal model and where the shipped image forming apparatus is used as the MPS model after the setting change. This will complicate inventory management of replacement parts.

An objective of an aspect of the invention is to allow a replacement part included with shipment to be usable even if the setting of the apparatus body is changed.

A first aspect of the invention is an image forming apparatus including: an apparatus body settable to any of at least first and second modes; a replacement part detachably attachable to the apparatus body; a first storage provided in the apparatus body and configured to store ID information for at least a selected one of the first and second modes; a second storage provided in the replacement part and configured to store ID information of the replacement part; and a determination section configured to compare the ID information of the apparatus body stored in the first storage with the ID information of the replacement part stored in the second storage to determine whether to permit use of the replacement part. The second storage of the replacement part shipped with the image forming apparatus stores at least first ID information for the first mode and second ID information for the second mode.

A second aspect of the invention is an image forming apparatus including: an apparatus body settable to any of a plurality of modes; a replacement part detachably attachable to the apparatus body; a first storage provided in the apparatus body and configured to store ID information for a selected one of the plurality of modes; a second storage provided in the replacement part and configured to store ID information of the replacement part; a third storage provided in the apparatus body and configured to store universal ID information which remains unchanged with a change in a setting of the apparatus body; and a determination section configured to compare the ID information of the apparatus body stored in the first or third storage with the ID information of the replacement part stored in the second storage to determine whether to permit use of the replacement part. The second storage of the replacement part shipped with the image forming apparatus stores ID information the same as the universal ID information stored in the first storage, and the determination section permits use of the replacement part installed in the apparatus body if the second storage stores the universal ID information.

A third aspect of the invention is an image forming apparatus including: an apparatus body settable to any of a plurality of modes; a replacement part detachably attachable to the apparatus body; a first storage provided in the apparatus body and configured to store ID information for a selected one of the plurality of modes; a second storage provided in the replacement part and configured to store ID information of the replacement part; and a determination section configured to compare the ID information of the apparatus body stored in the first storage with the ID information of the replacement part stored in the second storage to determine whether to permit use of the replacement part. The determination section permits use of the replacement part installed in the apparatus body if the ID information stored in the second storage of the replacement part shipped with the image forming apparatus is empty.

A fourth aspect of the invention is an image forming apparatus including: an apparatus body settable to any of a plurality of modes; a replacement part detachably attachable to the apparatus body; and a determination section configured to compare ID information of the apparatus body with ID information of the replacement part to determine whether to permit use of the replacement part. The determination section permits use of the replacement part included with factory shipment regardless of whether the mode set in the apparatus body is changed.

A fifth aspect of the invention is a method of managing use of a replacement part in an image forming apparatus in which an apparatus body is settable to any of a plurality of modes after shipment, the method comprising: storing information indicating that the replacement part is usable in the apparatus body even after the setting of the mode of the apparatus body is changed, the information being stored in a storage of the replacement part which is detachably attachable to the apparatus body and is shipped with the image forming apparatus; and reading the information of the replacement part and permitting use of the replacement part after the image forming apparatus is shipped.

According to the aspects of the invention, replacement parts shipped with the image forming apparatus can be used even if the setting of the mode of the apparatus body is changed.

DETAILED DESCRIPTION OF THE EMBODIMENTS

Figure 1:
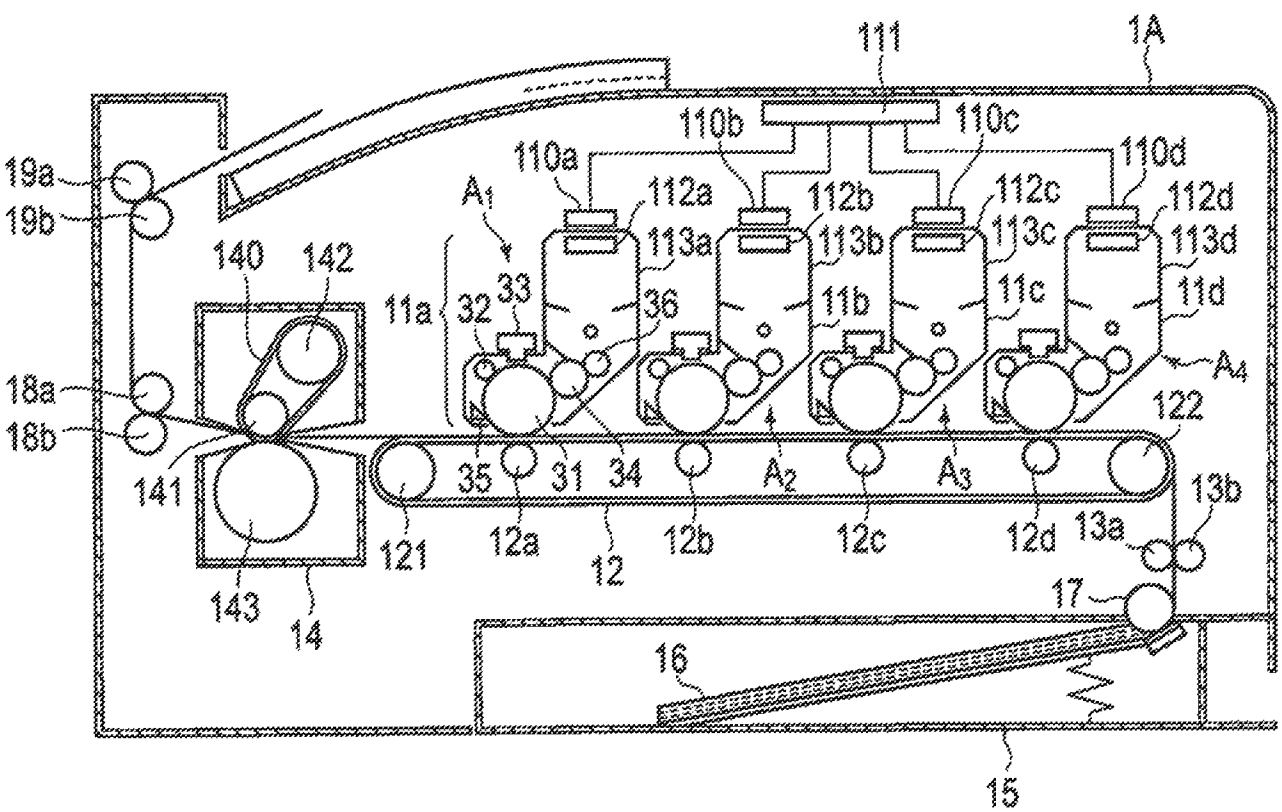
FIG. 1 is a side view showing a basic configuration of an image forming apparatus of a first embodiment of the invention.

Descriptions are provided herein below for embodiments based on the drawings. In the respective drawings referenced herein, the same constituents are designated by the same reference numerals and duplicate explanation concerning the same constituents is omitted. All of the drawings are provided to illustrate the respective examples only.

First Embodiment

FIG. 1 is a side view showing a basic configuration of an image forming apparatus 1 of a first embodiment of the invention. Image forming apparatus 1 shown in FIG. 1 is a color printer forming a color image on media 16 such as printing paper using electrophotography. Image forming apparatus 1 includes development units 11*a*, 11*b*, 11*c*, and 11*d* of yellow (Y), magenta (M), cyan (c), and black (K). Development units 11*a* to 11*d* are also referred to as image forming units or image drum units and are arranged in line along a path for transporting media 16.

Image forming apparatus 1 includes: medium tray 15 accommodating media 16; separation roller 17 separating and feeding media 16 one by one from medium tray 15 to the transport path; and transport rollers 13*a* and 13*b* transporting media 16 fed from medium tray 15 toward development units 11*a* to 11*d*.

Image forming apparatus 1 further includes: transfer belt 12 provided so as to face development units 11*a* to 11*d*, driving roller 121, and driven roller 122. The transfer belt 12 is laid over driving and driven dollars 121 and 122. Driving roller 121 is rotated by a not-shown driving source to move transfer belt 12 along development units 11*d*, 11*c*, 11*b*, and 11*a*. Furthermore, transfer rollers 12*a*, 12*b*, 12*c*, and 12*d* are provided so as to face photoreceptor drums 31 (described later) of development units 11*a* to 11*d* across transfer belt 12, respectively.

On the downstream of development units 11*a* to 11*d* in a direction that media 16 are transported, fixation unit 14 is provided. Fixation unit 14 includes fixation belt 140, pressure roller 141, heating roller 142, and pressure roller 143. Fixation belt 140 is wound with tension around pressure roller 141 and heating roller 142. Fixation belt 140 is nipped by pressure rollers 141 and 143. Fixation belt 140 heated by heating roller 142 is pressed against media 16 between upper and lower pressure rollers 141 and 143. It is also possible to use a fixation unit not including a fixation belt.

On the downstream of fixation unit 14, ejection rollers 18*a*, 18*b*, 19*a*, and 19*b* are provided. Ejection rollers 18*a*, 18*b*, 19*a*, and 19*b* eject media 16 with a toner image fixed thereon by fixation unit 14 to an ejection stacker at the top of image forming apparatus 1.

Next, a description is given of development units 11*a* to 11*d*. The development unit 11*a* includes photoreceptor drum 31 as a developer carrier rotating in one direction (clockwise in the drawing). Development unit 11*a* further includes charge roller 32, development roller 34, transfer roller 12*a*, and cleaning blade 35 which are arranged in the rotation direction of photoreceptor drum 31. Furthermore, exposure unit 33 is attached to upper cover 1A of image forming apparatus 1 (described later) so as to face photoreceptor drum 31.

Charge roller 32 (a charge member) is supplied with voltage from a not-shown power supply to rotate in contact with the surface of photoreceptor drum 31 and uniformly charges the surface of photoreceptor drum 31. Exposure unit 33 includes an LED head, for example, and exposes the surface of photoreceptor drum 31 according to image information to form an electrostatic latent image. Development roller 34 (a development member) applies toner (a developer) to the electrostatic latent image formed on the surface of photoreceptor drum 31 for development. Transfer roller 12*a* is supplied with voltage from a not-shown power supply and transfers the toner image formed on the surface of photoreceptor drum 31 to media 16. Cleaning blade 35 (a cleaning member) removes the toner remaining on the surface of photoreceptor drum 31 after the above transfer.

Development roller 34 is placed so as to face supply roller 36 which supplies toner to development roller 34. The development roller 34 and supply roller 36 constitute the development section. Other development units 11*b*, 11*c*, and 11*d* are configured in a similar manner to development unit 11*a* except for the type of toner.

Development units 11*a*, 11*b*, 11*c*, and 11*d* include detachably-attachable toner cartridges 113*a*, 113*b*, 113*c*, and 113*d* as developer containers which accommodate toners used by development units 11*a*, 11*b*, 11*c*, and 11*d*, respectively. The upper part of the body of image forming apparatus 1 is covered with the openable upper cover 1A. Toner cartridges 113*a* to 113*d* are attached and detached (replaced) with upper cover 1A being opened.

Portions of development units 11*a* to 11*d* except toner cartridges 113*a* to 113*d* (including photoreceptor drum 31, charge roller 32, development roller 34, transfer roller 12*a*, and cleaning blade 35) are indicated by development sections $A_1$ to $A_4$, respectively. These development sections $A_1$ to $A_4$ are also referred to as process units.

Figure 2A:
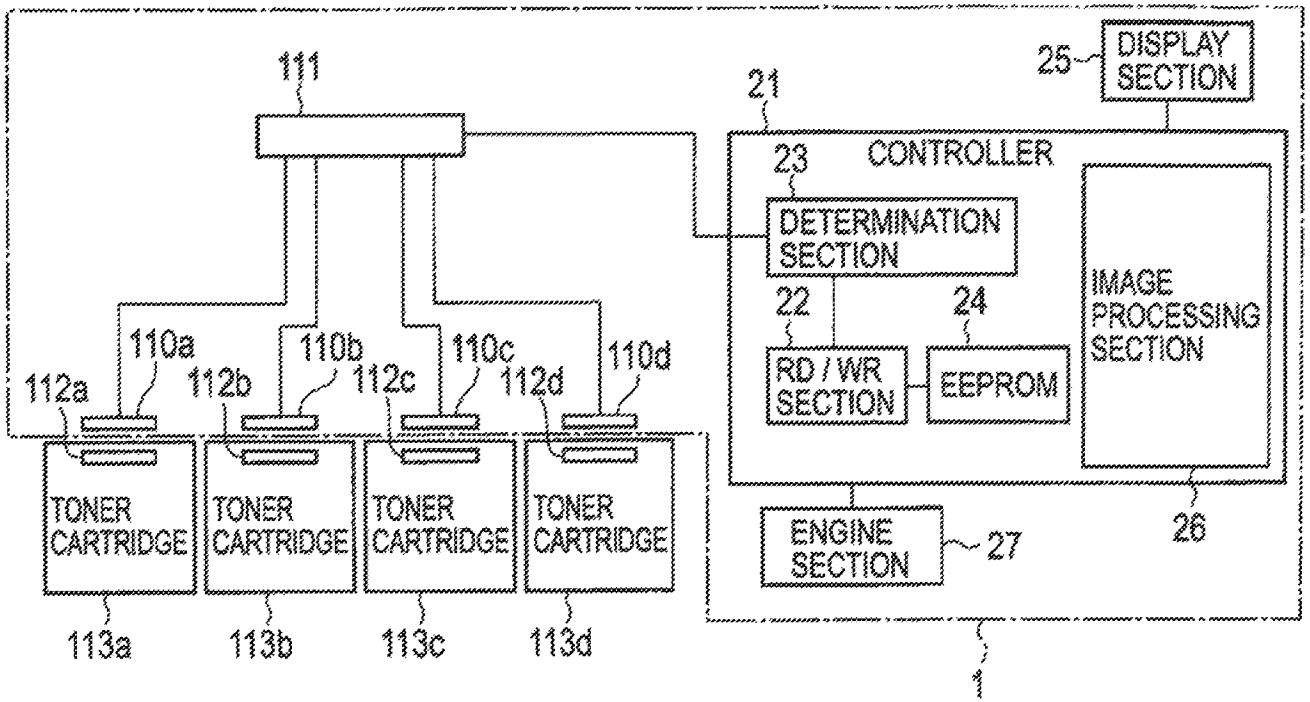
FIG. 2A is a block diagram showing a control system of the image forming apparatus of the first embodiment of the invention.

FIG. 2A is a block diagram showing a control system of image forming apparatus 1 of this embodiment. The above-described toner cartridges 113*a* to 113*d* incorporate wireless tags 112*a*, 112*b*, 112*c*, and 112*d*, respectively. Image forming apparatus 1 includes: transmission/reception antennas 110*a*, 110*b*, 110*c*, and 110*d* (transmission/reception sections) respectively used for communication with wireless tags 112*a* to 112*d*; and reader/writer unit 111 controlling reading and writing for wireless tags 112*a* to 112*d*.

Figure 2B:
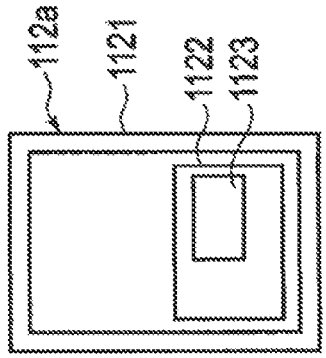
FIG. 2B is a view showing a configuration example of a wireless tag.

FIG. 2B shows a configuration example of wireless tag 112*a*. Wireless tag 112*a* is a non-contact IC, for example. Wireless tag 112*a* includes a substrate 1121 on which a tag chip 1122 is mounted and a not-shown antenna pattern formed. Tag chip 1122 incorporates non-volatile memory 1123 as a second storage.

Non-volatile memory 1123 (a second storage) stores specific information concerning toner cartridge 113*a* incorporating wireless tag 112*a*. The specific information is an ID code assigned to wireless tag 112*a* when wireless tag 112*a* is produced.

In FIG. 2A again, transmission/reception antenna 110*a* is fixed to a place facing wireless tag 112*a* incorporated in toner cartridge 113*a*, in image forming apparatus 1. Transmission/reception antenna 110*a* generates an alternating magnetic field for supplying electric power to wireless tag 112*a*. Through transmission/reception antenna 110*a*, wireless signals are exchanged with wireless tag 112*a*.

Other wireless tags 112*b*, 112*c*, and 112*d* have the same configuration as that of wireless tag 112*a*. Wireless tags 112*b*, 112*c*, and 112*d* are supplied with electric power to transmit and receive wireless signals through transmission/reception antennas 110*b*, 110*c*, and 110*d*, respectively.

Reader/writer unit 111 as a first reader/writer section is an apparatus supplying voltage and signals to transmission/reception antennas 110*a* to 110*d*. Reader/writer unit 111 is connected to transmission/reception antennas 110*a* to 110*d* through cables. Reader/writer unit 111 writes information to wireless tags 112*a* to 112*d* and reads information from wireless tags 112*a* to 112*d*.

Controller 21 of image forming apparatus 1 outputs driving control signals to engine section 27 including mechanical parts (including motors and the like) for feeding, transport, and ejection of media 16 and receives inputs of various sensor signals for controlling engine section 27. Controller 21 outputs control commands and the like to reader/writer unit 111 to perform reading and writing of information for wireless tags 112*a* to 112*d*. Furthermore, controller 21 includes image processing section 26 performing processing of print data and prints based on the print data input from an external device (a personal computer) and the like.

Controller 21 includes EEPROM (electrically erasable programmable ROM) 24 and read/write (RD/WR) section 22. EEPROM is a non-volatile memory as a first storage storing information including IDs of usable toner cartridges and the like. RD/WR section 22 is a second read/write section performing reading and writing of information for EEPROM 24. Controller 21 further includes determination section 23 configured to compare the specific information of wireless tags 112*a* to 112*d* read by reader/writer unit 111 with the specific information of EEPROM 24 read by RD/WR section 22 to determine the matching thereof.

Moreover, controller 21 is connected to display section 25 such as a liquid crystal display. Display section 25 displays messages to users and the like based on the instruction of controller 21.

Next, a description is given of a configuration to determine whether to permit use of toner cartridges 113*a* to 113*d*. In the description, the toner cartridges 113*a* to 113*d* are represented by toner cartridge 113, and the wireless tags 112*a* to 112*d* are represented by wireless tag 112.

In this embodiment, the apparatus body refers to a portion of image forming apparatus 1 in FIG. 1 other than detachably-attachable constituent components (toner cartridges 113*a* to 113*d*, development sections $A_1$ to $A_4$ development units 11*a* to 11*d*, fixation unit 14, and the like, for example). The following description is made using toner cartridge 113 as the detachably-attachable constituent element by way of example. For the convenience of description, therefore, the apparatus body refers to image forming apparatus 1 with toner cartridge 113 detached. However, the definition of the apparatus body in this embodiment is as described above.

Toner cartridge 113 is not installed in the apparatus body of image forming apparatus 1 before shipment of image forming apparatus 1. Toner cartridge 113 is packaged with the apparatus body (that is, included as an accessory) and is then delivered to a user's installation site. In the user's installation site, toner cartridge 113 is installed in the apparatus body of image forming apparatus 1.

On the other hand, when the user starts to use image forming apparatus 1 and then consumes all the toner in toner cartridge 113, toner cartridge 113 needs to be removed from the apparatus body of image forming apparatus 1 and to be replaced with a new toner cartridge 113. New toner cartridge 113 installed for replacement is referred to as a replacement toner cartridge and is distinguished from the toner cartridge shipped with image forming apparatus 1.

Figure 3:
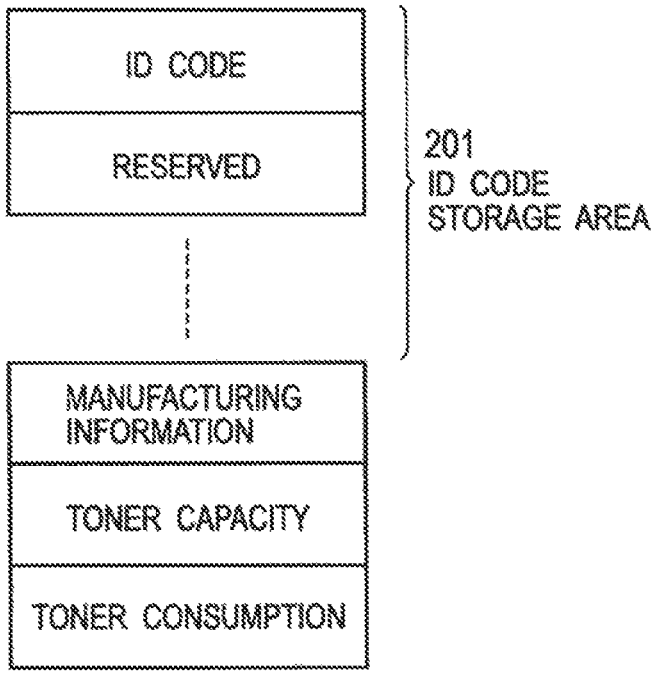
FIG. 3 is a view showing an example of information stored in a wireless tag attached to a replacement toner cartridge in the first embodiment of the invention.

FIG. 3 shows an example of information stored in wireless tag 112 attached to replacement toner cartridge 113. Wireless tag 112 stores an ID code (ID information) as the specific information, manufacturing information (production year and month and production factory), the toner capacity of the cartridge, the consumption of toner, and the like. Wireless tag 112 includes ID code storage area 201 storing a plurality of ID codes. In the case of replacement toner cartridge 113, ID code storage area 201 stores one of ID code 1 indicating the toner cartridge usable in a normal model and ID code 2 indicating the toner cartridge usable in a MPS model.

Figure 4:
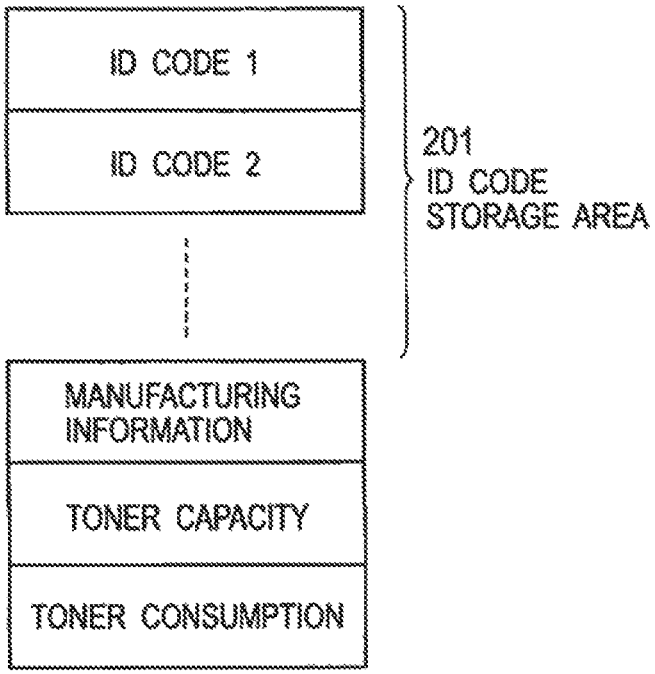
FIG. 4 is a view showing an example of information stored in a wireless tag attached to a replacement toner cartridge shipped with the image forming apparatus in the first embodiment of the invention.

FIG. 4 shows an example of information stored in wireless tag 112 attached to toner cartridge 113 shipped with image forming apparatus 1 as an accessory. ID code storage area 201 of toner cartridge 113 included with shipment stores both of ID code 1 permitting use in the normal model and ID code 2 permitting use in the MPS model.

The basic operation of image forming apparatus 1 is described below. In each of development units 11*a* to 11*d* in FIG. 1, the surface of photoreceptor drum 31 is uniformly charged by charge roller 32 and is then exposed by exposure unit 33 based on image data of each color, thus forming an electrostatic latent image. The electrostatic latent image on the surface of photoreceptor drum 31 is developed by development roller 34 into a toner image.

On the other hand, media 16 accommodated in medium tray 15 are fed one by one by separation roller 17 and are then transported to transfer belt 12 by transport rollers 13*a* and 13*b*. Furthermore, media 16 are attracted to and held on transfer belt 12 to be transported sequentially through development units 11*d*, 11*c*, 11*b*, and 11*a*. At that time, the toner images of different colors formed on the surfaces of photoreceptor drums 31 are sequentially transferred onto the surfaces of media 16. On the surface of each media 16, a color toner image is thus transferred.

Media 16 with the toner image transferred thereon are transported to fixation unit 14 and are pressed against heated fixation belt 140 between upper and lower pressure rollers 141 and 143. The toner image is fixed to media 16 by heat and pressure. Media 16 are then ejected to the ejection stacker by ejection rollers 18*a*, 18*b*, 19*a*, and 19*b*.

Figure 5:
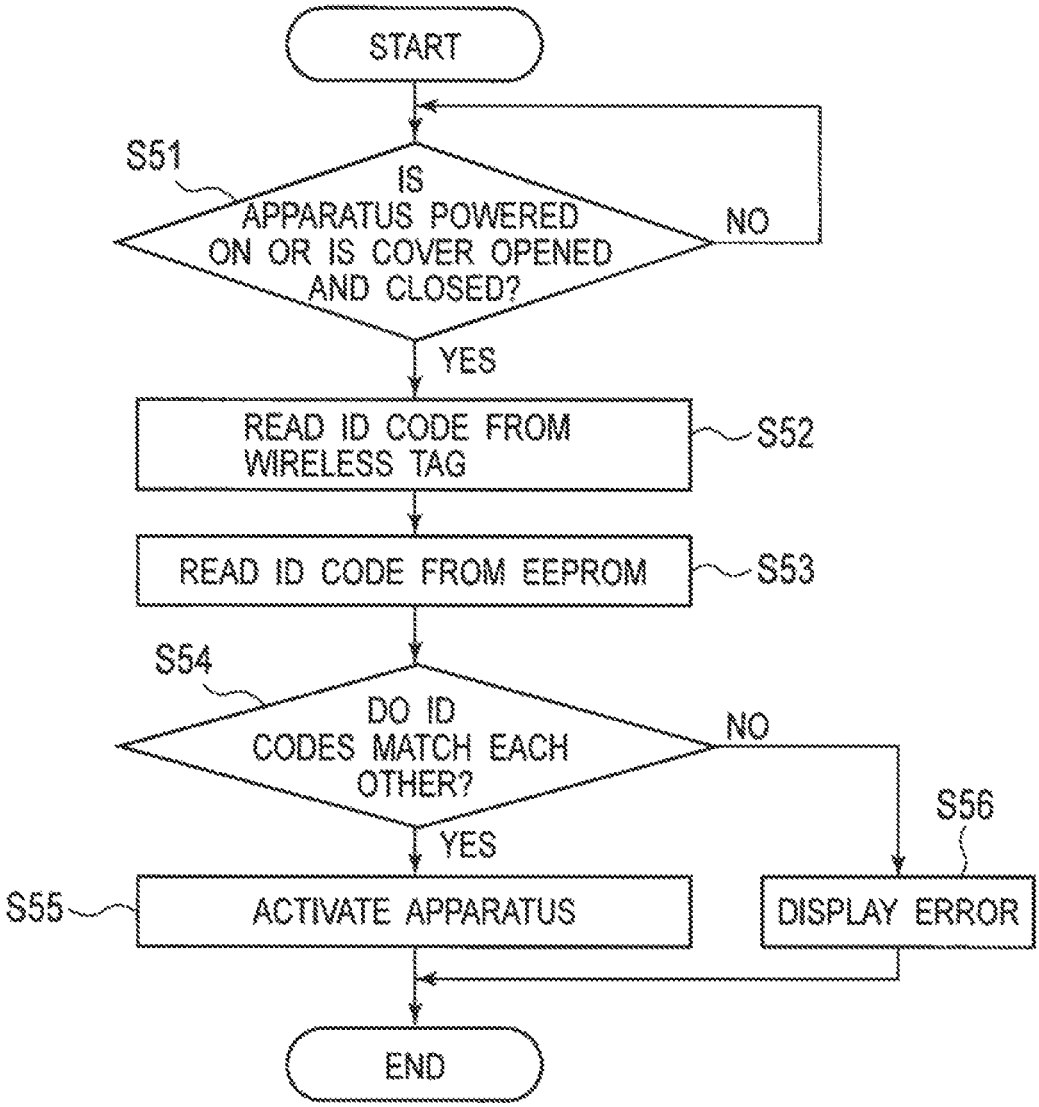
FIG. 5 is a flowchart showing a process to determine whether to permit use of the toner cartridge in the first embodiment of the invention.

Next, a description is given of control concerning determination of whether to permit use of a toner cartridge in this embodiment. FIG. 5 shows a flowchart showing a process to determine whether to permit use of a toner cartridge in this embodiment. As described above, after image forming apparatus 1 is placed, toner cartridge 113 (included with shipment) is installed in the apparatus body of image forming apparatus 1. When image forming apparatus 1 is used to consume all toner of toner cartridge 113, toner cartridge 113 is replaced. Accordingly, controller 21 of image forming apparatus 1 executes the process to determine whether to permit use of toner cartridge 113, as shown in FIG. 5, when the image forming apparatus 1 is powered on or when upper cover 1A is opened and closed.

First, when image forming apparatus 1 is powered on or when upper cover 1A is opened and closed (step S51), controller 21 reads all the ID codes stored in ID code storage area 201 of wireless tag 112 of toner cartridge 113 through reader/writer unit 111 (step S52). Controller 21 reads the ID code of toner cartridge 113 usable in image forming apparatus 1 from EEPROM 24 through RD/WD section 22 (step S53).

Next, determination section 23 of controller 21 determines, based on the ID codes read at step S52 and S53, whether toner cartridge 113 is usable in image forming apparatus 1 (step S54). If the ID code read from EEPROM 24 matches one of the ID codes read from wireless tag 112, determination section 23 determines that toner cartridge 113 is usable. In this case, controller 21 activates image forming apparatus 1, or allows image forming apparatus 1 to form images (step S55). On the other hand, if the ID code read from EEPROM 24 does not match any one of the ID codes read from wireless tag 112, determination section 23 determines that toner cartridge 113 is unusable. In this case, controller 21 displays a predetermined message (an error message, for example) on display section 25 (step S56).

Figure 6:
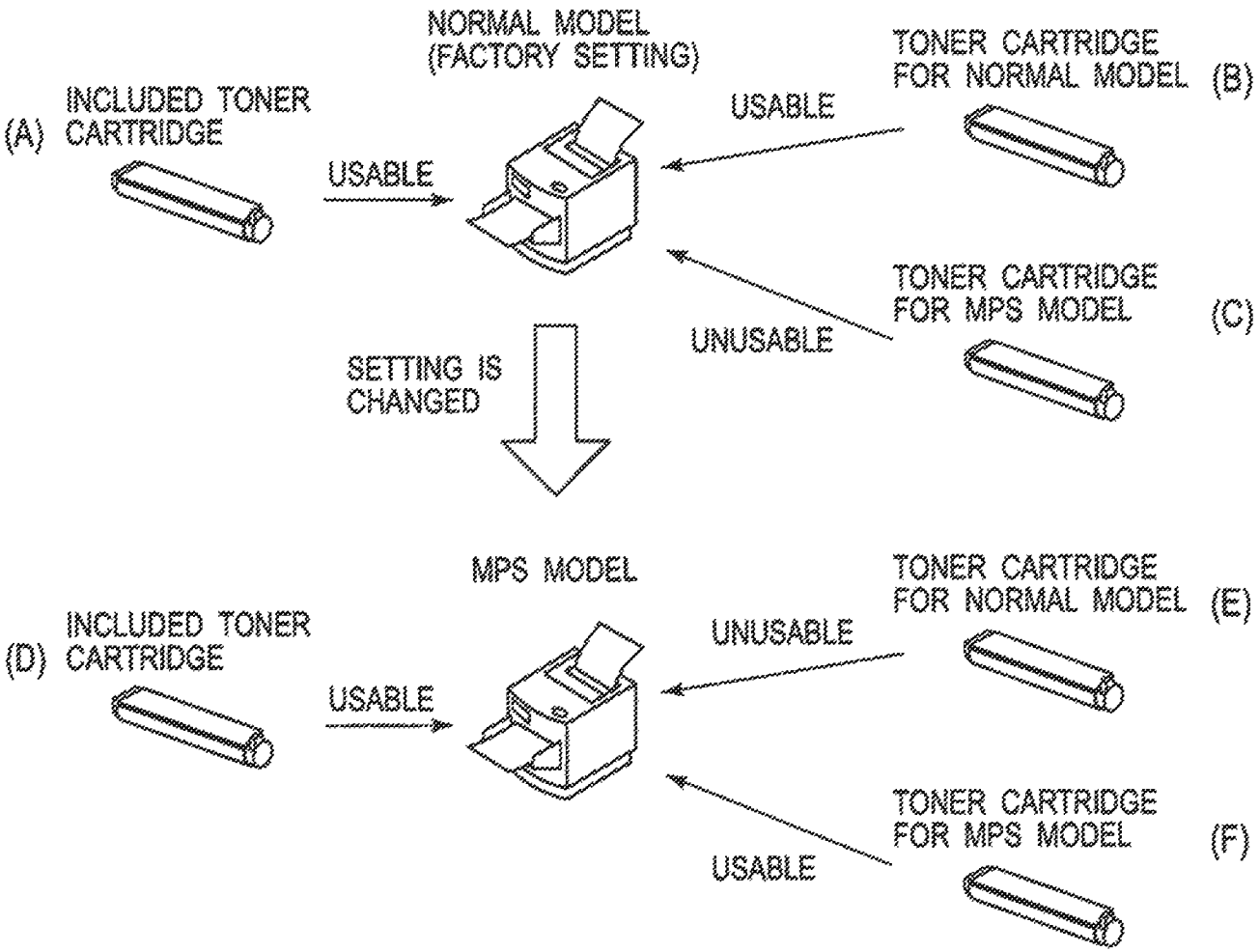
FIG. 6 is a schematic view showing operational examples of the image forming apparatus of the first embodiment of the invention.

FIG. 6 shows an operational example of image forming apparatus 1. Image forming apparatus 1 is classified as the normal model or MPS (managed printing service) model. As for the normal model, toner cartridge 113 is directly charged. The MPS model is charged based on the number of prints. Image forming apparatus 1 is always set as the normal model before shipment. When a user wants a MPS model, service staff changes the setting of image forming apparatus 1 to the MPS model when installing image forming apparatus 1. EEPROM 24 of image forming apparatus 1 therefore stores ID code 1 as the ID of usable toner cartridge 113 before shipment.

First, a description is given of a case where the user buys and uses image forming apparatus 1 as the normal model. In this case, the setting of EEPROM 24 is not changed. When toner cartridge 113 included with shipment is installed in image forming apparatus 1 and image forming apparatus 1 is activated ((A) in FIG. 6), controller 21 reads ID code 1 and ID code 2 from wireless tag 112 and reads ID code 1 from EEPROM 24 (steps S52 and S53 of FIG. 5). ID code 1 read from wireless tag 112 matches ID code 1 as the usable toner cartridge read from EEPROM 24. Determination section 23 therefore determines that installed the toner cartridge 113 is usable, and image forming apparatus 1 is activated (steps S54 and S55 of FIG. 5).

When toner cartridge 113 installed in image forming apparatus 1 is replaced with new toner cartridge 113 for the normal model whose wireless tag 112 stores ID code 1 ((B) in FIG. 6), ID code 1 stored in wireless tag 112 matches ID code 1 stored in EEPROM 24. New toner cartridge 113 is therefore determined to be usable, and image forming apparatus 1 is then activated.

On the other hand, when toner cartridge 113 installed in image forming apparatus 1 is replaced with new toner cartridge 113 for the MPS model whose wireless tag 112 stores only ID code 2 ((C) in FIG. 6), ID code 2 stored in wireless tag 112 does not match ID code 1 stored in EEPROM 24. New toner cartridge 113 is therefore determined to be unusable.

Next, a description is given of a case where the user buys and uses image forming apparatus 1 as the MPS model. In this case, the setting of image forming apparatus 1 is changed from the normal model to the MPS model. The ID code of the usable toner cartridge stored in EEPROM 24 of image forming apparatus 1 is changed from ID code 1 to ID code 2 by RD/WR section 22. Herein, the change of the setting from the normal model to the MPS model is performed by the service staff.

For activation of image forming apparatus 1 in which toner cartridge 113 included with shipment is installed ((D) in FIG. 6), controller 21 reads ID code 1 and ID code 2 (FIG. 4) from wireless tag 112 and reads ID code 2 from EEPROM 24. ID code 2 read from wireless tag 112 matches ID code 2 of usable toner cartridge 113 read from EEPROM 24. Determination section 23 therefore determines that installed toner cartridge 113 is usable, and image forming apparatus 1 is then activated.

When toner cartridge 113 installed in image forming apparatus 1 is replaced with new toner cartridge 113 for the MPS model whose wireless tag 112 stores only ID code 2 ((F in FIG. 6), ID code 2 stored in wireless tag 112 matches ID code 2 stored in EEPROM 24, and determination section 23 determines that new toner cartridge 113 is usable. Image forming apparatus 1 is then activated.

On the other hand, when toner cartridge 113 installed in image forming apparatus 1 is replaced with toner cartridge 113 for the normal model whose wireless tag 112 stores only ID code 1 ((E in FIG. 6), ID code 1 stored in wireless tag 112 does not match ID code 2 stored in EEPROM 24. Determination section 23 therefore determines that toner cartridge 113 is unusable.

As described above, since wireless tag 112 of toner cartridge 113 shipped with image forming apparatus 1 stores both ID code 1 and ID code 2, toner cartridge 113 can be used either when the setting of image forming apparatus 1 remains the normal model or is changed to the MPS model ((A) and (D) in FIG. 6). This eliminates the need to prepare both toner cartridges for the normal model and the MPS model, thus facilitating stock inventory.

Moreover, toner cartridge 113 of image forming apparatus 1 which is in use as the normal model can be replaced with only toner cartridge 113 for the normal model ((B) in FIG. 6). Furthermore, toner cartridge 113 of image forming apparatus 1 whose setting is changed to the MPS model can be replaced with only toner cartridge for the MPS model ((F) in FIG. 6). It is therefore possible to maintain the exclusivity of replacement parts.

Figure 7:
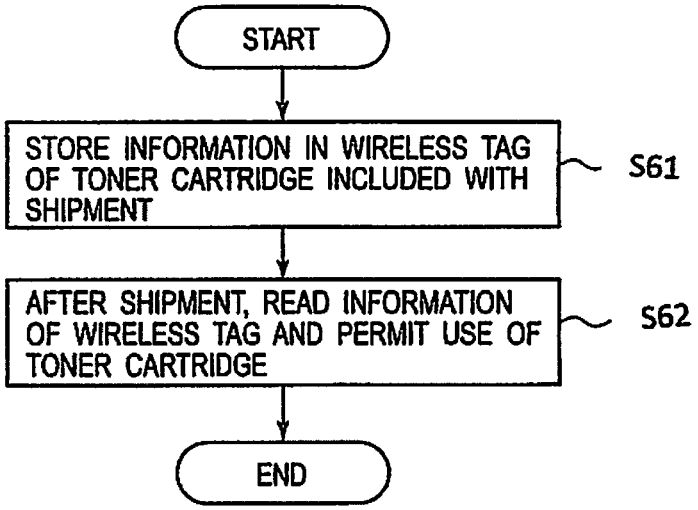
FIG. 7 is a flowchart showing a method of managing use of a replacement part in the first embodiment of the invention.

FIG. 7 is a flowchart summarizing a method of managing use of toner cartridge 113 as a replacement part of image forming apparatus 1. As shown in FIG. 7, wireless tag 112 of toner cartridge 113 shipped with image forming apparatus 1 stores ID code 1 and ID code 2. Wireless tag 112 of toner cartridge 113 stores information permitting use of toner cartridge 113 in image forming apparatus 1 regardless of the change in setting of image forming apparatus 1 (either when the setting remains the normal model or is changed to the MPS model) (step S61).

After shipment of image forming apparatus 1, as described with reference to FIG. 5, controller 21 of image forming apparatus 1 reads information of wireless tag 112 of toner cartridge 113 which is installed in the apparatus body of image forming apparatus 1 and permits use of toner cartridge 113 (step S62).

As described above, according to the embodiment, wireless tag 112 of toner cartridge 113 shipped with information forming apparatus 1 stores both ID code 1 and ID code 2. Accordingly, toner cartridge 113 included with shipment can be used either when the setting of image forming apparatus 1 remains the normal model or is changed to the MPS model. Accordingly, it is only necessary to prepare one type of toner cartridge as toner cartridge 113 shipped with image forming apparatus 1. This can facilitate stock inventory.

Moreover, in the case of replacing toner cartridge 113 installed in image forming apparatus 1 with new toner cartridge 113, image forming apparatus 1 of the normal model can use only toner cartridge 113 for the normal model, and image forming apparatus 1 of the MPS model can use only toner cartridge 113 for the MPS model. This can maintain the exclusivity of replacement parts.

The above description is made for the case when the setting of image forming apparatus 1 is changed to the normal model (a first mode) or the MPS model (a second mode). This embodiment is also applicalble to the case where the setting can be changed to three or more modes. For example, when image forming apparatus 1 includes three modes, wireless tag 112 (the second storage) of toner cartridge 113 shipped with image forming apparatus 1 stores first, second, and third IDs for first, second, and third modes, respectively.

Second Embodiment

In the aforementioned first embodiment, it is necessary to write a number of ID codes in wireless tag 112 of toner cartridge 113 shipped with image forming apparatus 1 when image forming apparatus 1 can be set to a number of models. Since wireless tag 112 has limited storage capacity, the number of usable models is limited. In order to make toner cartridge 113 usable in more types of models, wireless tag 112 needs to increase in capacity. This will increase the cost. Moreover, it takes longer time to read the ID codes. Accordingly, the second embodiment of invention is configured as follows.

Figure 8A:
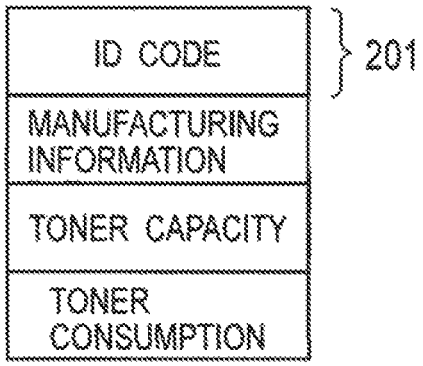
FIGS. 8A and 8B are views showing examples of information stored in a wireless tag in a second embodiment of the invention.

FIG. 8A is a view showing an example of information stored in wireless tag 112 of replacement toner cartridge 113. In this embodiment, ID code storage area 201 of wireless tag 112 is capable of storing only one ID code. ID code storage area 201 of wireless tag 112 of replacement toner cartridge 113 stores one of ID code 1 (ID code permitting use in image forming apparatus 1 of the normal model) and ID code 2 (ID code permitting use in image forming apparatus 1 of the MPS model). In other words, if replacement toner cartridge 113 is for the normal model, ID code storage area 201 of wireless tag 112 stores ID code 1. If replacement toner cartridge 113 is for the MPS model, ID code storage area 201 of wireless tag 112 stores ID code 2.

Figure 8B:
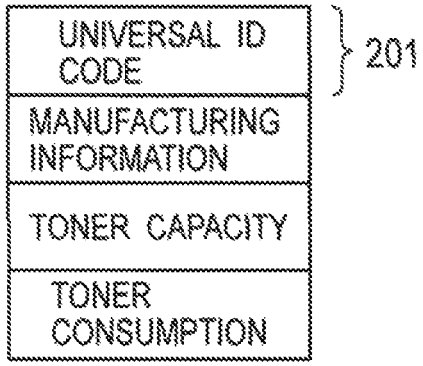

FIG. 8B is a view showing an example of information stored in wireless tag 112 of toner cartridge 113 shipped with image forming apparatus 1. As shown in FIG. 8B, wireless tag 112 of toner cartridge 113 shipped with image information apparatus 1 stores universal ID code or common ID code in ID code storage area 201. The universal ID code permits use of toner cartridge 113 in either image forming apparatus 1 set to the normal model (first mode) or image forming apparatus 1 set to the MPS model (second mode). In other words, the universal ID code permits use of toner cartridge 113 in all the modes to which image forming apparatus 1 can be set.

Figure 9:
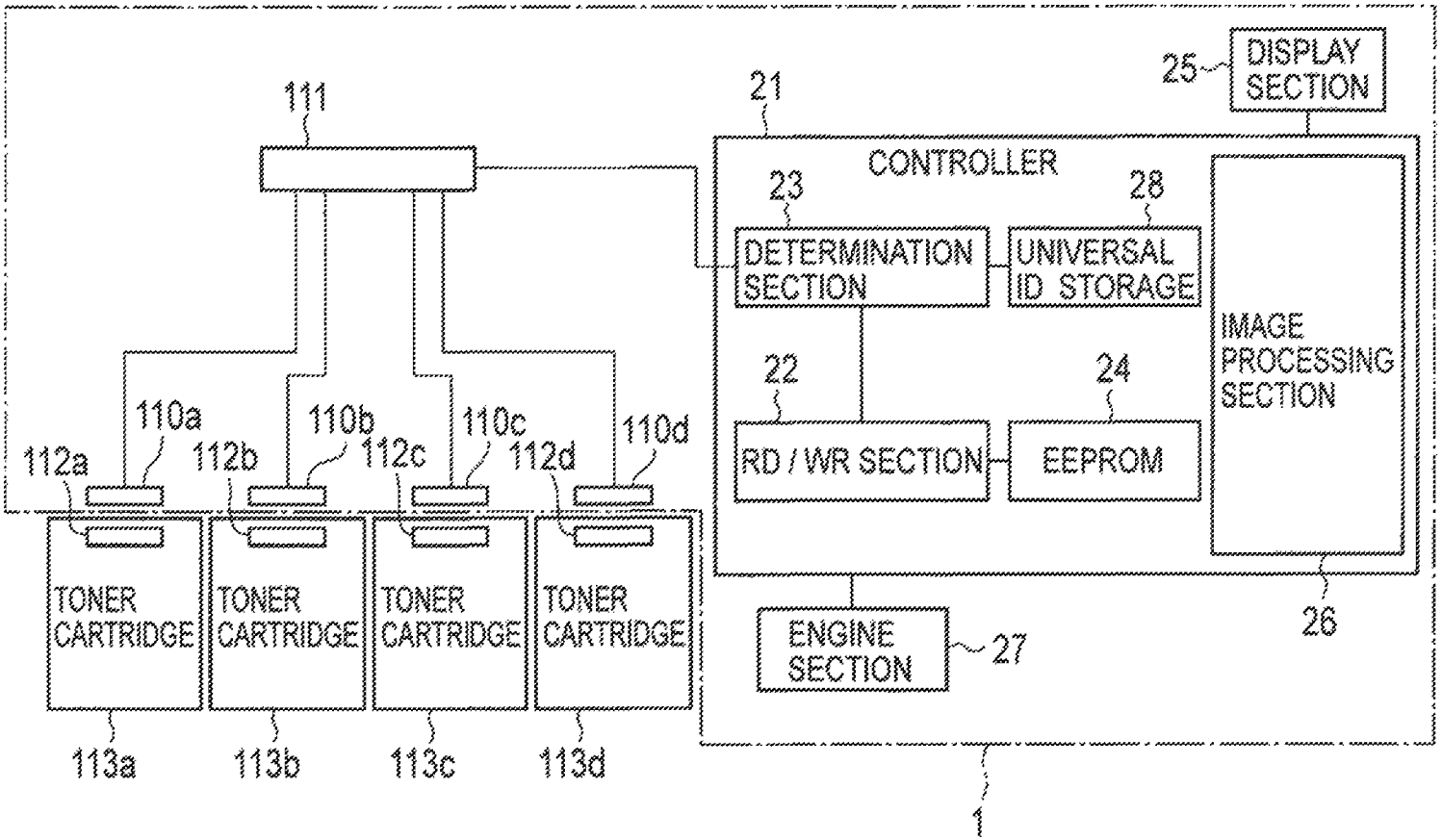
FIG. 9 is a block diagram showing a control system of an image forming apparatus of the second embodiment of the invention.

FIG. 9 is a block diagram showing a control system of image forming apparatus 1 in the second embodiment. The constituent components the same as those of the first embodiment are given the same reference numerals. In image forming apparatus 1 of this embodiment, unlike the above first embodiment, controller 21 includes universal ID storage 28 as a third storage. Universal ID storage 28 stores the universal ID code. Universal ID storage 28 is separated from EEPROM 24 in this embodiment, but universal ID code may be stored in EEPROM 24.

Figure 10:
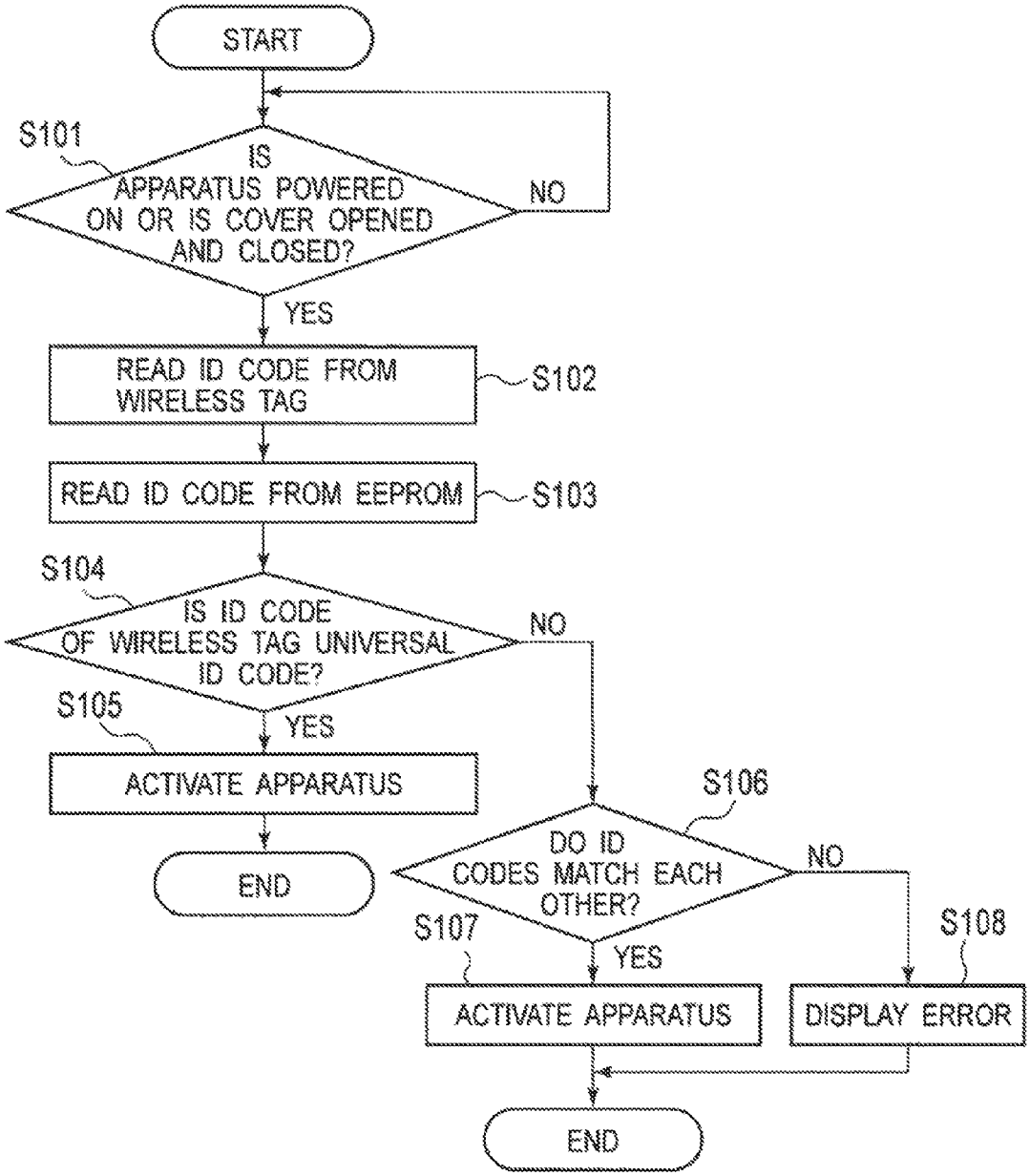
FIG. 10 is a flowchart showing a process to determine whether to permit use of a toner cartridge in the second embodiment of the invention.

FIG. 10 is a flowchart showing a process to determine whether to permit use of toner cartridge 113 in the second embodiment. When image forming apparatus 1 is powered on or the upper cover 1A is opened and closed (step S101), controller 21 reads the ID code stored in ID code storage area 201 of wireless tag 112 of toner cartridge 113 through reader/writer unit 111 (step S102). Controller 21 reads the ID code of the toner cartridge 113 usable in image forming apparatus 1 from EEPROM 24 (step S103).

Next, determination section 23 of controller 21 determines whether the ID code read from wireless tag 112 is a universal ID code (step S104). If the ID code is a universal ID code, toner cartridge 113 is determined to be usable, and image forming apparatus 1 is activated (step S105). On the other hand, if the ID code is not a universal ID code, determination section 23 determines whether the ID code read from wireless tag 112 matches the ID code read from EEPROM 24 (step S106). If the ID code read from wireless tag 112 matches the ID code read from EEPROM 24, determination section 23 determines that the installed toner cartridge is usable. In this case, controller 21 activates image forming apparatus 1 (step S107). On the other hand, if the ID code read from wireless tag 112 does not match the ID code read from EEPROM 24, determination section 23 determines that the installed toner cartridge is unusable. In this case, controller 21 displays a message such as an error message on display section 25 (step S108).

A description is given of an operational example in this embodiment. Image forming apparatus 1 is set to the normal model before shipment. In this state, EEPROM 24 of image forming apparatus 1 stores ID code 1 as the ID code of the usable toner cartridge 113.

First, the description is given of a case where a user buys and uses the image forming apparatus 1 as the normal model. In this case, the setting of EEPROM 24 is not changed. For activation of image information forming apparatus 1 in which toner cartridge 113 included with shipment is installed, controller 21 reads the universal ID code and reads the ID code 1 from EEPROM 24 (steps S102 and S103 of FIG. 10). Since the ID code read from wireless tag 112 is a universal ID code, determination section 23 determines that the installed toner cartridge 113 is usable, and image forming apparatus 1 is activated (steps S104 and S105).

When toner cartridge 113 is replaced with toner cartridge 113 for the normal model whose wireless tag 112 stores only ID code 1, ID code 1 stored in wireless tag 112 matches ID code 1 stored in EEPROM 24, and replaced toner cartridge 113 is determined to be usable. On the other hand, when toner cartridge 113 is replaced with toner cartridge 113 for the MPS model whose wireless tag 112 stores only ID code 2, ID code 2 stored in wireless tag 112 does not match ID code 1 stored in EEPROM 24, and toner cartridge 113 is determined to be unusable.

Next, the description is given of a case where a user buys and uses image forming apparatus 1 as the MPS model. In this case, the setting of EEPROM 24 is changed from the normal model to the MPS model, and the ID code of the usable toner cartridge 113 which is stored in EEPROM 24 is changed from ID code 1 to ID code 2. For activation of image forming apparatus 1 in which toner cartridge 113 included with shipment is installed, controller 21 reads the universal ID code from wireless tag 112 and reads ID code 2 from EEPROM 2. Since the ID code read from wireless tag 112 is a universal ID code, determination section 23 determines that installed toner cartridge 113 is usable, and image forming apparatus 1 is then activated.

When toner cartridge 113 is replaced with toner cartridge 113 for the normal model whose wireless tag 112 stores only ID code 1, ID code 1 stored in wireless tag 112 matches ID code 1 stored in EEPROM 24, and replaced toner cartridge 113 is determined to be usable. On the other hand, when toner cartridge 113 is replaced with toner cartridge 113 for the MPS model whose wireless tag 112 stores only ID code 2, ID code 2 stored in wireless tag 112 does not match ID code 1 stored in EEPROM 24, and toner cartridge 113 is determined to be unusable.

According to this embodiment, it is possible to address an increase in types of models (the number of models) to which the image forming apparatus 1 can be set without increasing the storage capacity of wireless tag 112 and increasing the reading time.

Modification

Figure 11:
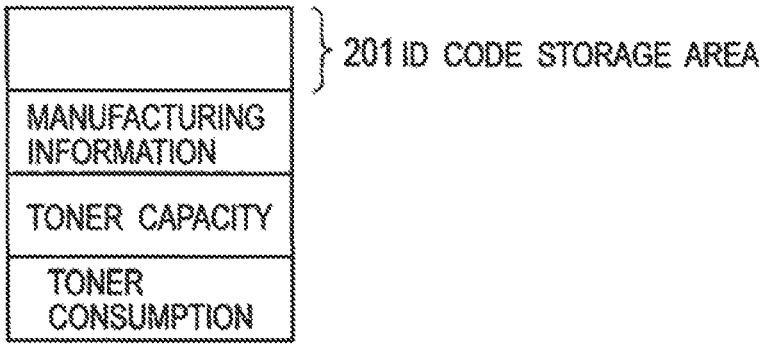
FIG. 11 is a view showing an example of information stored in a wireless tag attached to a replacement toner cartridge shipped with the image forming apparatus in a modification of the second embodiment of the invention.
Figure 12:
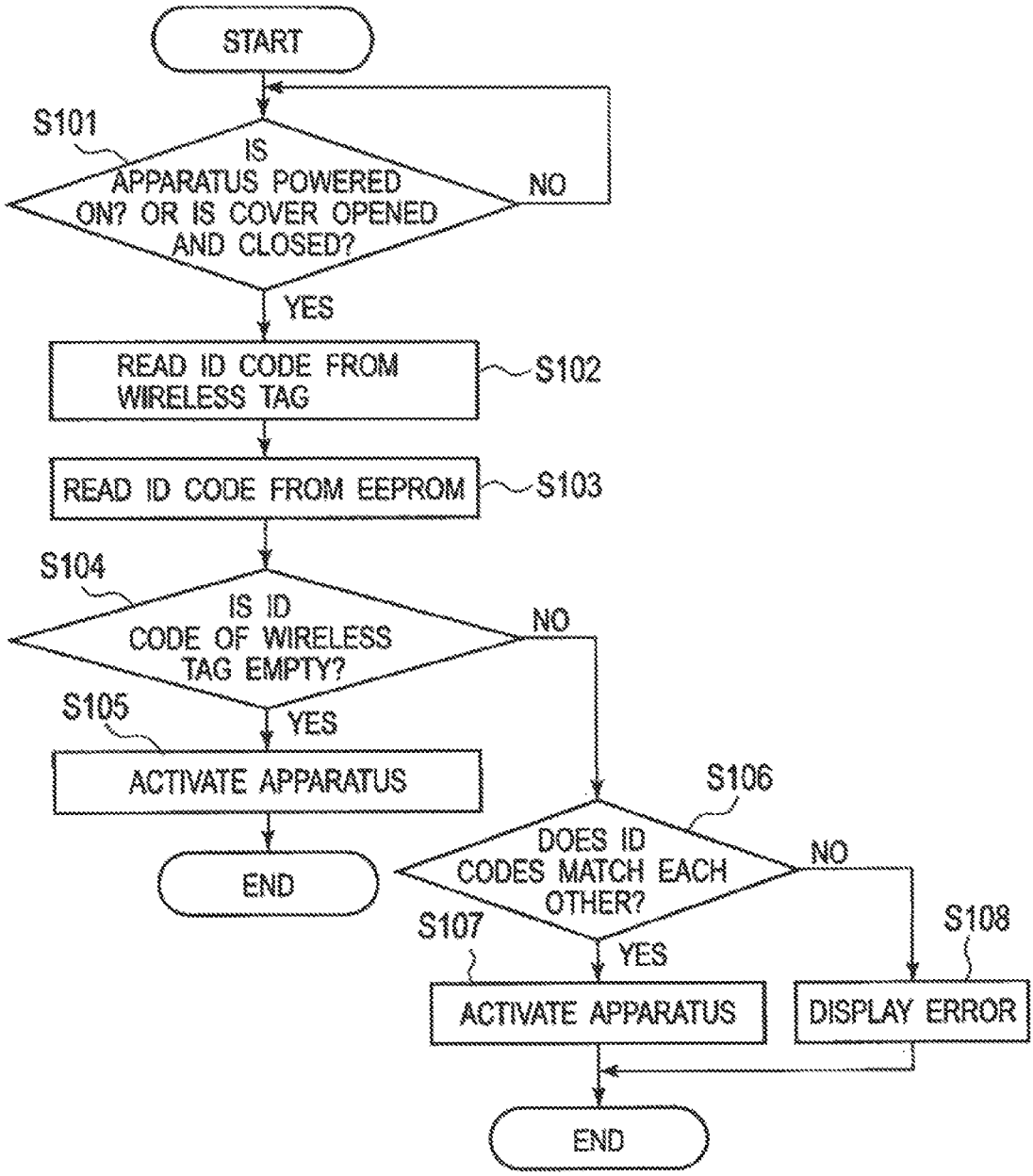
FIG. 12 is a flowchart showing a process to determine whether to permit use of a toner cartridge in the modification of the second embodiment of the invention.

Next, a description is given of a modification of the second embodiment. FIG. 11 is a view showing an example of information stored in wireless tag 112 attached to toner cartridge 113 shipped with image forming apparatus 1 in the modification of the second embodiment. FIG. 12 is a flowchart showing a process to determine whether to permit use of toner cartridge 113.

In the above second embodiment, if wireless tag 112 attached to toner cartridge 113 shipped with image forming apparatus 1 stores a universal ID code, toner cartridge 113 included with shipment is determined to be usable regardless of the setting of image forming apparatus 1. In this modification, as shown in FIG. 11, ID code storage area 201 of wireless tag 112 of toner cartridge 113 shipped with image forming apparatus 1 is set empty (a state with no ID information being stored).

The process to determine whether to permit use of toner cartridge 113 is performed in the same way as described in the second embodiment (FIG. 10). However, instead of determining whether the ID code is a universal ID code in step S104, determination section 23 determines whether ID code storage area 201 of wireless tag 112 is empty (step S104). If ID code storage area 201 of wireless tag 112 is empty, determination section 23 determines that the installed toner cartridge 113 is usable, and image forming apparatus 1 is then activated (step S105). On the other hand, if ID code storage area 201 of wireless tag 112 is not empty, determination section 23 determines whether the ID code read from wireless tag 112 matches the ID code read from EEPROM 24 (step S106). The subsequent steps are the same as described in the second embodiment (FIG. 10).

In this modification, it is also possible to address an increase in the number of types of models (the number of modes) to which image forming apparatus 1 can be set without increasing the storage capacity of wireless tag 112 and increasing the reading time.

Third Embodiment

Figure 13:
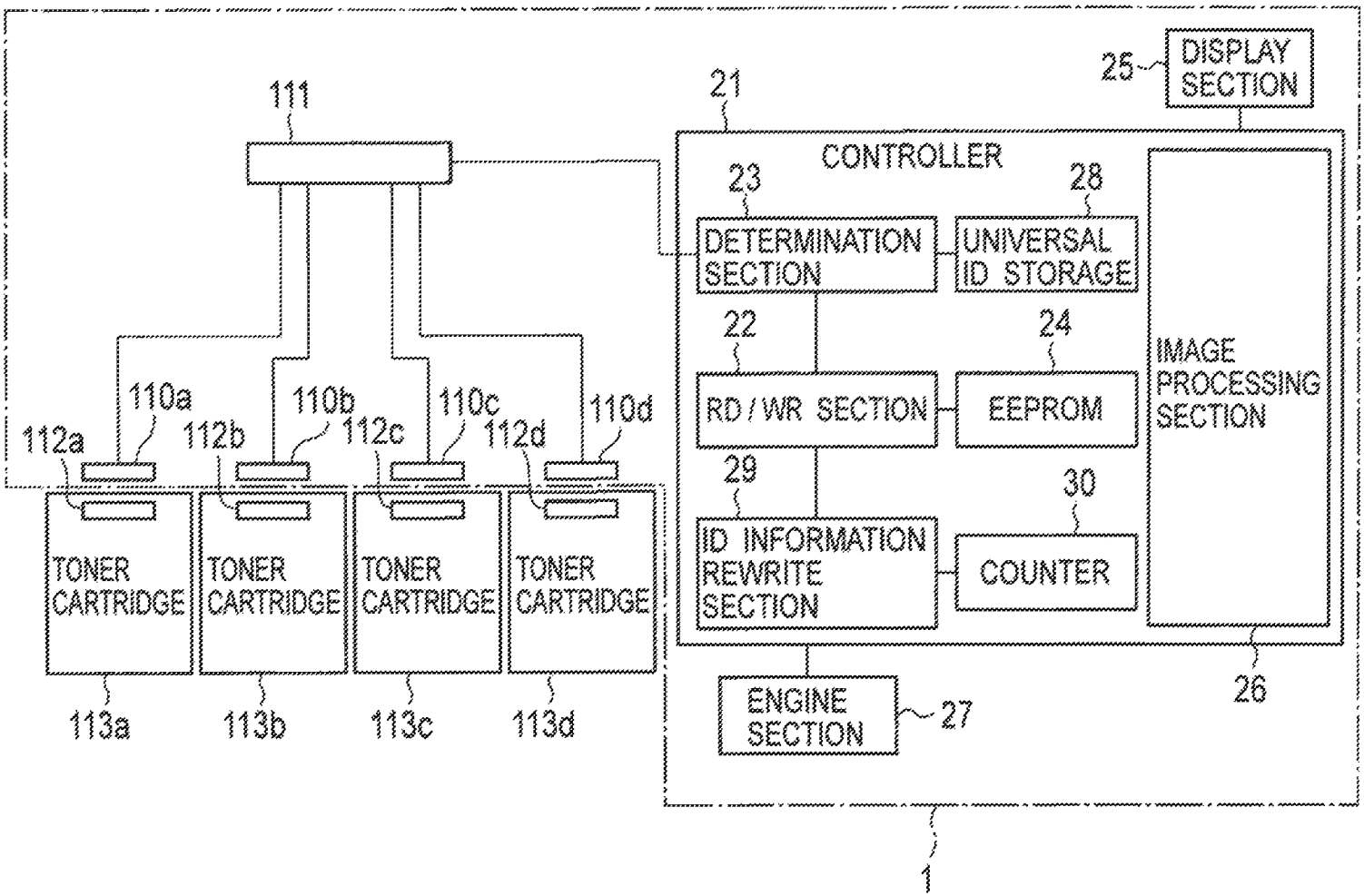
FIG. 13 is a block diagram showing a control system of an image forming apparatus of a third embodiment of the invention.
Figure 14:
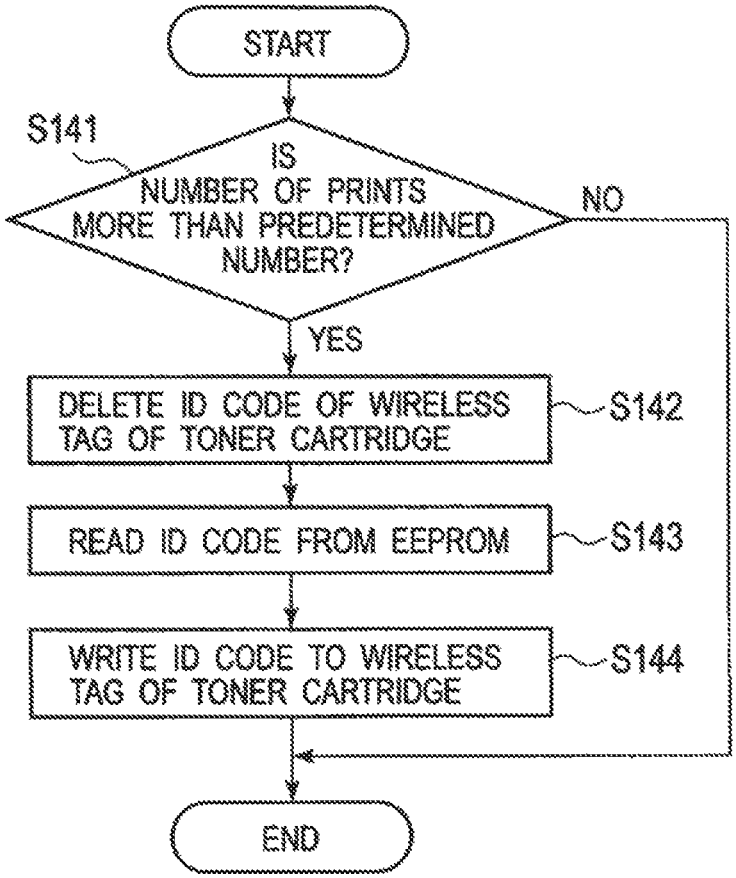
FIG. 14 is a flowchart showing a process to rewrite an ID code of a wireless tag in the third embodiment of the invention

Next, a description is given of a third embodiment of the invention. FIG. 13 is a block diagram showing a control system of image forming apparatus 1 of the third embodiment. FIG. 14 is a flowchart showing the process to rewrite the ID code of wireless tag 112 of toner cartridge 113. In FIG. 13, the constituent components the same as those of the second embodiment are given the same reference numerals.

As shown in FIG. 13, in contrast to image forming apparatus 1 of the second embodiment, image forming apparatus 1 of the third embodiment further includes ID information rewrite section 29 and counter 30 (FIG. 10). ID information rewrite section 29 replaces the ID code of wireless tag 112 of toner cartridge 113 shipped with universal ID code being stored, with the same ID code stored in EEPROM 24 after the setting of image forming apparatus 1 is changed. Counter 30 counts the number of prints printed by image forming apparatus 1.

The process to rewrite the ID code of wireless tag 112 of toner cartridge 113 in this embodiment is described with reference to FIG. 14. The process (flow) of FIG. 14 is executed at each predetermined time interval using a not-shown timer, for example. Controller 21 determines whether the count value of counter 30 (the number of prints) exceeds a predetermined value (step S141). The predetermined value is set to 1 herein.

As described above, the change of the setting (normal model/MPS model) after shipment is performed by service staff when image forming apparatus 1 is installed, and a not-shown operation section of image forming apparatus 1 is operated for test printing in many cases. Accordingly, it can be determined that the change of the setting of image forming apparatus 1 to the MPS model is completed or that image forming apparatus 1 is determined to be used as the normal model if image forming apparatus 1 is instructed by the upper-level apparatus to complete at least one print (image formation).

If the counter value of counter 30 exceeds the predetermined value (step S141), ID information rewrite section 29 of controller 21 instructs reader/writer unit 111 to delete the ID code (almighty ID code) stored in wireless tag 112 of toner cartridge 113 (step S142). Subsequently, ID information rewrite section 29 instructs RD/WD section 22 to read the ID code stored in EEPROM 24 (step S143). Furthermore, ID information writing section 28 writes the same ID code as read from EEPROM 24 to wireless tag 112 of toner cartridge 113 (step S144).

In this embodiment, as described above, the ID code stored in wireless tag 112 of toner cartridge 113 shipped with image forming apparatus 1 can be rewritten according to the mode (normal model/MPS model) of image forming apparatus 1 decided after shipment. After shipment as described above, included toner cartridge 113 can function as a toner cartridge compatible with the setting specific to the apparatus.

Herein, the description is given of the example in which ID information rewrite section 29 and counter 30 are added to image forming apparatus 1 (FIG. 9) of the second embodiment. However, ID information rewrite section 29 and counter 30 may be added to image forming apparatus 1 of the first embodiment. In this case, all the ID data sets stored in wireless tag 112 are deleted in above step S142, and then the same ID code as read from EEPROM 24 is written in wireless tag 112 in steps S143 and S144.

Moreover, this embodiment is applicable to the modification of the second embodiment. In this case, toner cartridge 113 including wireless tag 112 provided with empty ID code storage region 201 is shipped with image forming apparatus 1. Accordingly, the process to delete information of wireless tag 112 in the step S142 of FIG. 14 can be omitted.

In the above description, the process to rewrite the ID code in FIG. 14 is executed based on the counter but not limited to this. The process to rewrite the ID code may be executed each time that the printing operation is completed, for example. Moreover, in the above description, counter 30 counts the number of times of printing (image formation) based on the instruction from the upper level apparatus but is not limited to this. Counter 30 may be configured to count the number of times of activation of image forming apparatus 1, for example. Alternatively, the ID code may be rewritten after a predetermined period of time using a timer instead of the counter.

Figure 15:
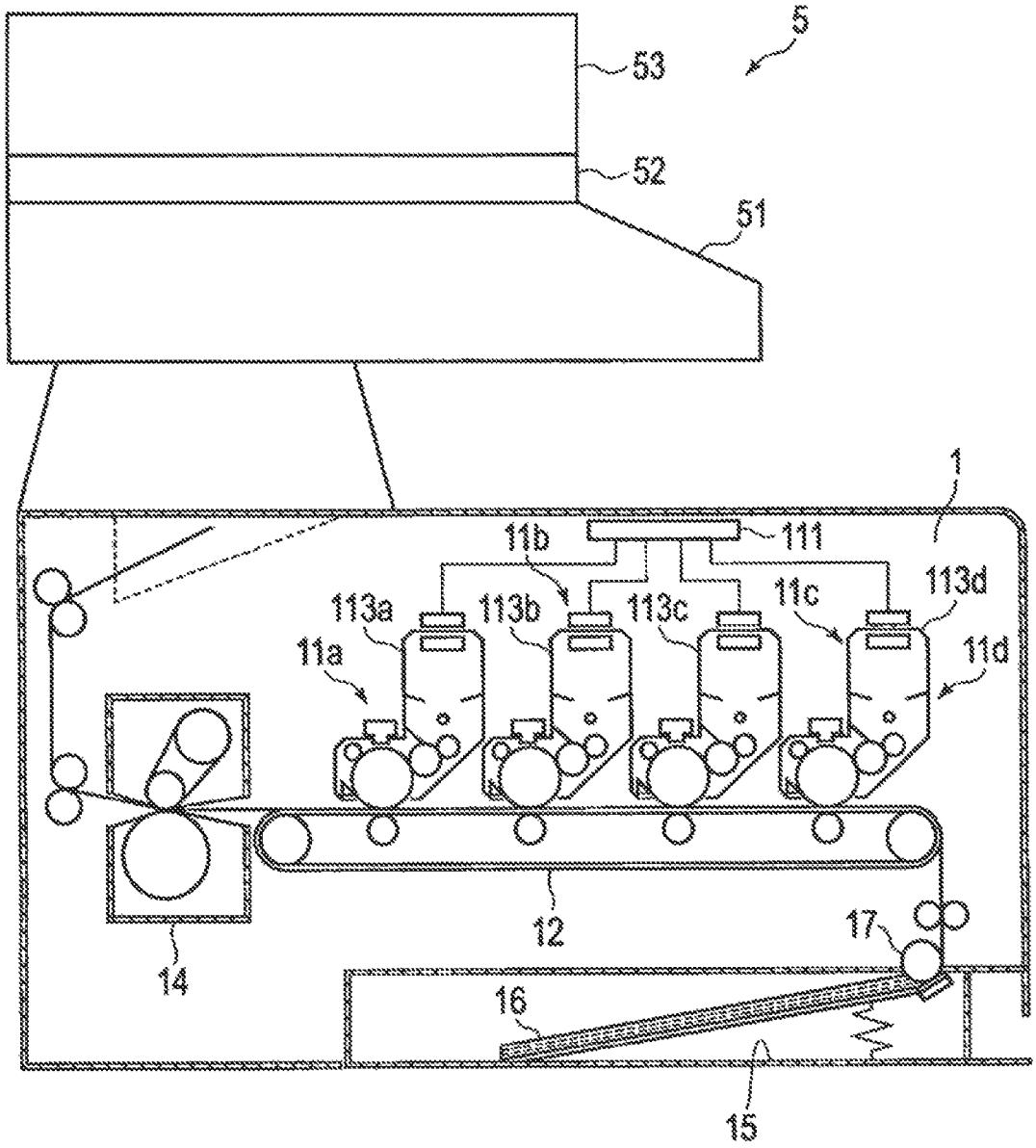
FIG. 15 is a view showing an example of a multifunction apparatus to which each embodiment or modification of the invention is applicable.

In the aforementioned embodiments and modification, the image forming apparatus is described. The invention may be applied to a multifunction apparatus, for example. A multifunction apparatus schematically shown in FIG. 15 includes image forming apparatus 1 and image reading apparatus 5. Image forming apparatus 1 is the same as described with reference to FIG. 1. Image reading apparatus (scanner section) 5 includes: a body section 51 including a flat bed on which documents are placed; a cover 52 which is openable and closable, and covers the body section 51; and an ADF (automatic document feeder) 53 configured to feed documents. The body section 51 includes a reading sensor which reads the document placed on the flat bed. The reading sensor digitizes the image of the read documents and feeds the same to image forming apparatus 1. Image forming apparatus 1 then performs image formation. It is obvious that the multifunction apparatus to which the invention is applicable is not limited to the configuration shown in FIG. 15.

In the description of the aforementioned embodiments and modification, the description is given of the wireless tag as a storage mounted on the toner cartridge as a replacement part by example. The storage is not limited to the wireless tag and only needs to be a storage capable of communicating with the controller, for example, a wired EEPROM or the like.

Furthermore, in the aforementioned embodiments and modification, the description is given of the toner cartridge as an example of the replacement part. The replacement part only needs to be detachably attachable to the apparatus body for replacement and is not limited to the toner cartridge. For example, the replacement part may be the development section, development unit, fixation unit, belt unit, or an arbitrary combination thereof.

Figure 16:
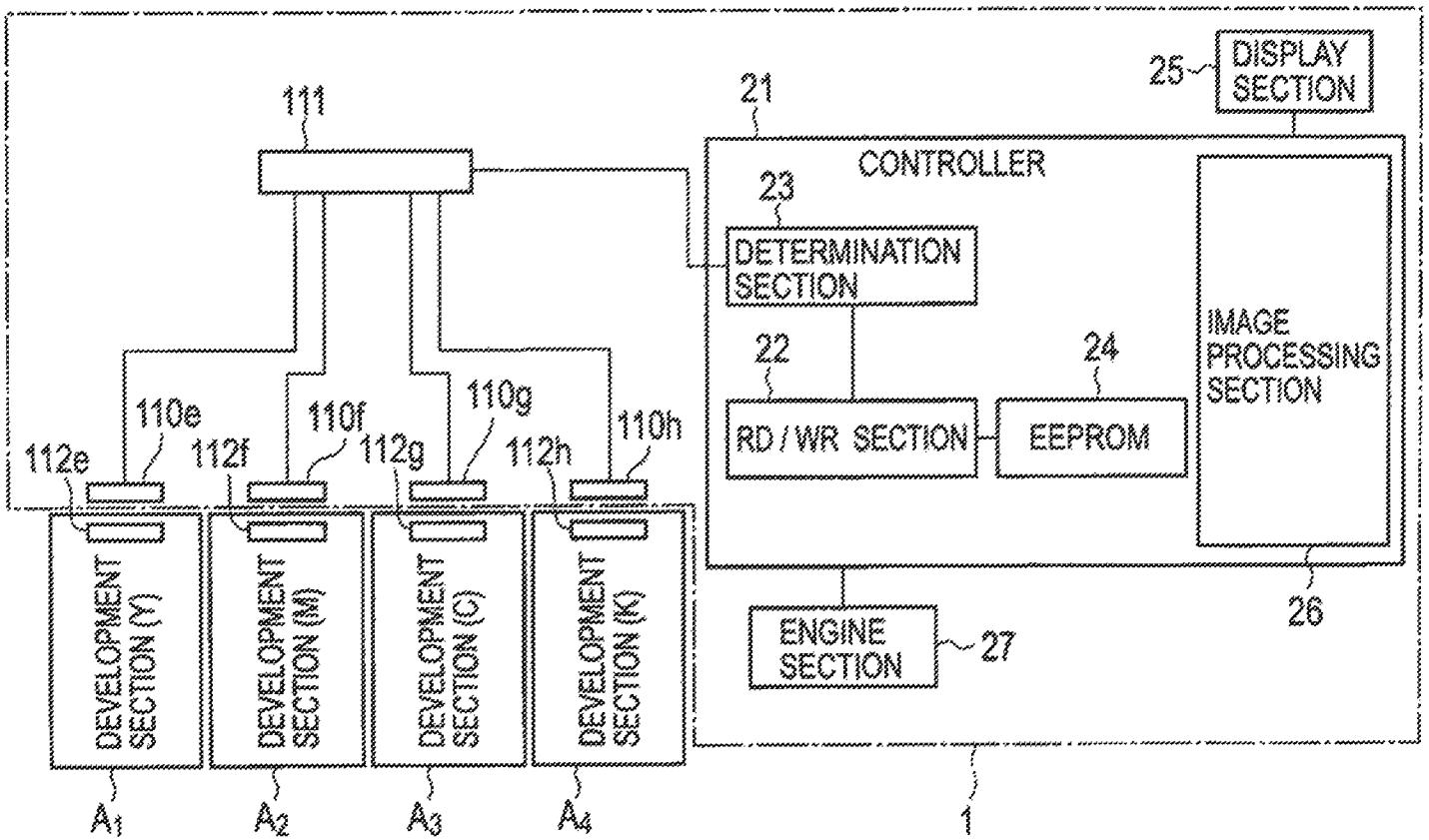
FIG. 16 is a view showing another configuration example of the image forming apparatus of each embodiment or modification of the invention.

For example, as shown in FIG. 16, development sections $A_1$ to $A_4$ are provided with wireless tags 112*e*, 112*f*, 112*g*, and 112*h*, respectively. ID codes stored in wireless tags 112*e* to 112*h* are received by transmission/reception antennas 110*e*, 110*f*, 110*g*, and 110*h*, respectively, and the determination section 23 is determined based on the received ID codes. In this case, the development sections $A_1$ to $A_4$ may be integrated with toner cartridges 113*a* to 113*d*, respectively.

Figure 17:
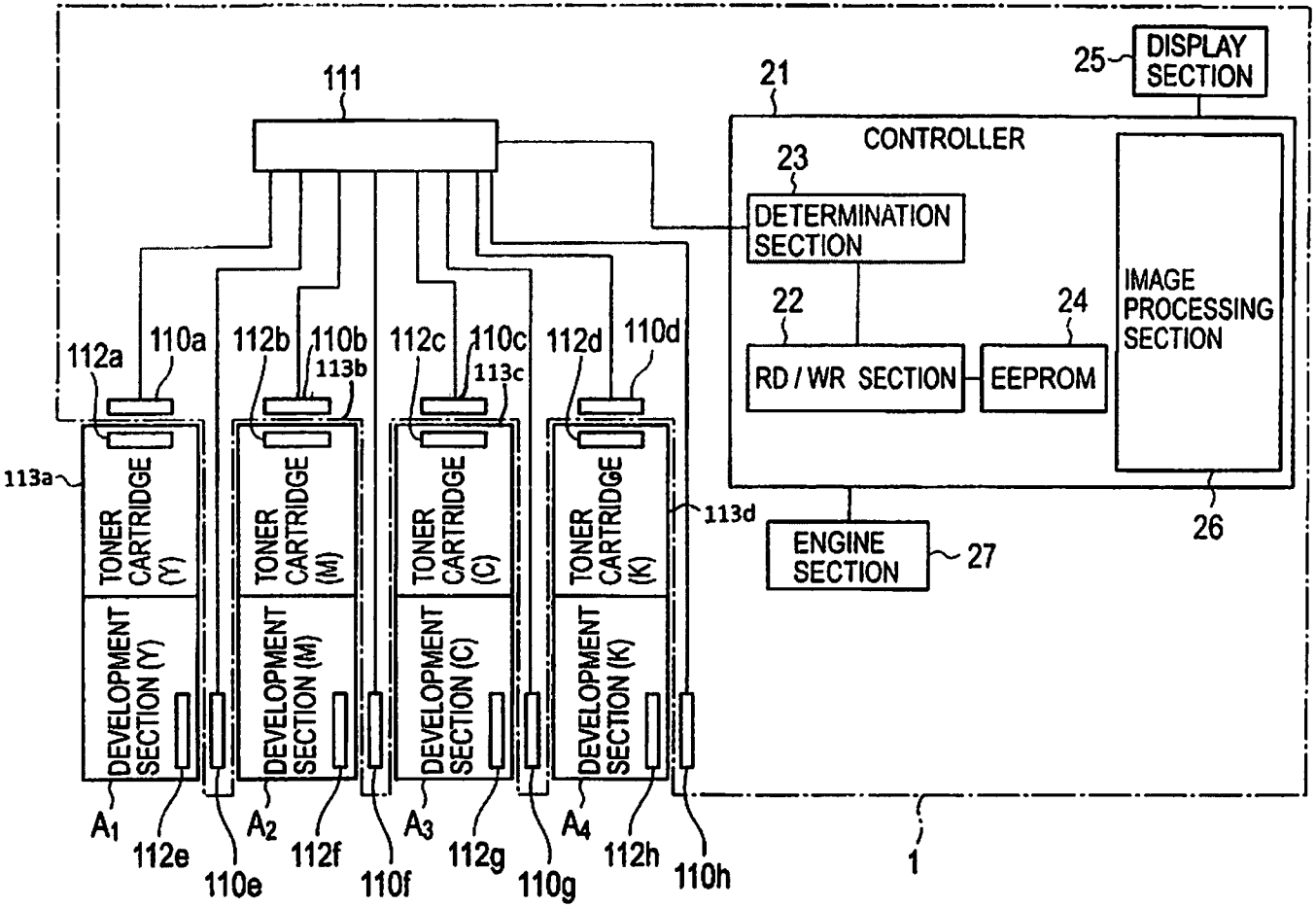
FIG. 17 is a view showing still another configuration example of the image forming apparatus of each embodiment or modification of the invention.

As shown in FIG. 17, wireless tags 112*a* to 112*h* may be provided in development sections $A_1$ to $A_4$ and toner cartridges 113*a* to 113*d*. ID codes stored in wireless tags 112*a* to 112*h* are received by transmission/reception antennas 110*a* to 110*h*, and determination section 23 performs the determination based on all the ID codes.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image forming apparatus, comprising:

an apparatus body settable to any of at least first and second modes;

a replacement part detachably attachable to the apparatus body;

a first storage provided in the apparatus body and configured to store ID information for at least a selected one of the first and second modes;

a second storage provided in the replacement part and configured to store ID information of the replacement part; and a determination section configured to compare the ID information of the apparatus body stored in the first storage with the ID information of the replacement part stored in the second storage to determine whether to permit use of the replacement part, wherein the second storage of the replacement part shipped with the image forming apparatus stores at least first ID information for the first mode and second ID information for the second mode.

2. The image forming apparatus according to claim 1, further comprising:

an ID information rewrite section configured to rewrite the ID information stored in the second storage provided in the replacement part; and a count section configured to count the number of times that the image forming apparatus prints, wherein the ID information rewrite section writes the ID information stored in the first storage to the second storage when a counted value of the count section reaches a predetermined value.

3. The image forming apparatus according to claim 1, wherein the determination section compares the ID information of the apparatus body with the ID information of the replacement part to determine whether to permit use of the replacement part when the image forming apparatus is powered on or when a cover of the apparatus body is opened and closed.

4. The image forming apparatus according to claim 1, wherein the determination section displays a predetermined message on a display section when not permitting use of the replacement part.

5. The image forming apparatus according to claim 1, wherein the replacement part is a toner cartridge.

6. The image forming apparatus according to claim 1, wherein the second storage is a wireless tag.

7. A multifunction apparatus comprising the image forming apparatus of claim 1.

8. An image forming apparatus, comprising:

an apparatus body settable to any of a plurality of modes;

a replacement part detachably attachable to the apparatus body;

a first storage provided in the apparatus body and configured to store ID information for a selected one of the plurality of modes;

a second storage provided in the replacement part and configured to store ID information of the replacement part;

a third storage provided in the apparatus body and configured to store universal ID information which remains unchanged with a change in a setting of the apparatus body; and a determination section configured to compare the ID information of the apparatus body stored in the first or third storage with the ID information of the replacement part stored in the second storage to determine whether to permit use of the replacement part, wherein the second storage of the replacement part shipped with the image forming apparatus stores ID information the same as the universal ID information stored in the third storage, and the determination section permits use of the replacement part installed in the apparatus body if the second storage stores the universal ID information.

9. The image forming apparatus of claim 8, wherein the first and third storages are formed of a same storage.

10. The image forming apparatus of claim 8, wherein the determination section determines whether the ID information of the apparatus body stored in the first storage matches the ID information of the replacement part stored in the second storage if the ID information stored in the second storage is not the universal ID information, and the determination section permits use of the replacement part if the ID information of the apparatus body matches the ID information of the replacement part.

11. An image forming apparatus, comprising:

an apparatus body settable to any of a plurality of modes;

a replacement part detachably attachable to the apparatus body;

a first storage provided in the apparatus body and configured to store ID information for a selected one of the plurality of modes;

a second storage provided in the replacement part and configured to store ID information of the replacement part; and a determination section configured to compare the ID information of the apparatus body stored in the first storage with the ID information of the replacement part stored in the second storage to determine whether to permit use of the replacement part, wherein the determination section permits use of the replacement part installed in the apparatus body if the ID information stored in the second storage of the replacement part shipped with the image forming apparatus is empty.

12. The image forming apparatus of claim 11, wherein if the ID information stored in the second storage is not empty, the determination section determines whether the ID information of the apparatus body matches the ID information of the replacement part, and if the ID information of the apparatus body matches the ID information of the replacement part, the determination section permits use of the replacement part.

* * * * *